US006269672B1

(12) United States Patent
Schutz

(10) Patent No.: US 6,269,672 B1
(45) Date of Patent: Aug. 7, 2001

(54) INDENTATIONS TO CONTROL METAL CURLING

(76) Inventor: Joseph J. Schutz, 61 Colchester Commons, Colchester, CT (US) 06415-2137

( * ) Notice: Subject to any disclaimer, the term of this patent is extended or adjusted under 35 U.S.C. 154(b) by 0 days.

(21) Appl. No.: 09/506,491

(22) Filed: Feb. 18, 2000

Related U.S. Application Data

(60) Provisional application No. 60/138,021, filed on Jun. 8, 1999.

(51) Int. Cl.[7] ..... B21D 53/40
(52) U.S. Cl. ..... 72/379.2; 29/11
(58) Field of Search ..... 72/379.2; 59/6, 59/8; 29/11

(56) References Cited

U.S. PATENT DOCUMENTS

| | | | | |
|---|---|---|---|---|
| 846,139 | * | 3/1907 | Pruden | 72/379.2 |
| 1,197,271 | | 9/1916 | Dieckmann . | |
| 1,810,716 | * | 6/1931 | Locke | 59/6 |
| 4,380,573 | | 4/1983 | Näslund . | |
| 4,748,838 | | 6/1988 | Cornelison . | |
| 5,051,294 | | 9/1991 | Lunkas et al. . | |
| 5,062,286 | | 11/1991 | Sjöblom . | |

FOREIGN PATENT DOCUMENTS

| | | | | |
|---|---|---|---|---|
| 2 197 810 | * | 6/1988 | (GB) | 72/379.2 |
| 54-2260 | * | 1/1979 | (JP) | 72/379.2 |

* cited by examiner

*Primary Examiner*—Lowell A. Larson
(74) *Attorney, Agent, or Firm*—Richard C. Litman

(57) ABSTRACT

A method of curling a first metal portion of a planar workpiece over a second cooperating curled workpiece by making indentations in the first metal portion on the inside surface of the portion to be curled by a machine punch. A hinge can be constructed with this improvement.

6 Claims, 5 Drawing Sheets

INDENTATIONS TO CONTROL METAL CURLING

CROSS-REFERENCE TO RELATED APPLICATION

This application claims the benefit of U.S. Provisional Patent Application Ser. No. 60/138,021, filed Jun. 8, 1999.

BACKGROUND OF THE INVENTION

1. Field of the Invention

The present invention relates generally to a method for controlling the curling of metals. More specifically, this invention relates to a method of fabricating a metal device such as a hinge, wherein indentations are made in a metal work piece to control the curling aspect of the metal being worked on.

2. Description of Related Art

The related art of interest describes various methods and apparatus for bending metal workpieces, but none describes the present invention of forming specific indentations to improve the curling process. The related art will be discussed in the order of perceived relevance to the present invention.

U.S. Pat. No. 5,062,286 issued on Nov. 5, 1991, to Bengt I. G. Sjöblom describes a method and apparatus for bending a corrugated sheet transversely of the corrugations in which the valleys of the corrugated sheet are clamped against a die in an edging press device by tongues of a pressfoot while a fold line or weakening is pressed, in the form of an indentation into the corrugations' crests by a bar. The fold line or weakening enables the sheet to be subsequently bent to a desired angle over the edge of a bench or support surface. The method and apparatus are distinguishable for bending a corrugated metal sheet.

U.S. Pat. No. 5,051,294 issued on Sep. 24, 1991, to Michael J. Lunkas et al. describes a catalytic converter substrate and assembly formed of steel sheets embossed with corrugations in a chevron pattern such that the metal buckles at the vertices of the adjoining corrugations to form projections extending out of the plane of the sheet. The sheets are stacked with the projections registered to form weld points, and capacitive discharge welding secures the sheets together. The substrate is formed into two halves which are clamped together and secured by end rings. The catalytic converter substrate is distinguishable for forming vertices to buckle the corrugated sheet to form projections for weld points.

U.S. Pat. No. 4,380,573 issued on Apr. 19, 1993, to Gustav Näslund describes a method and device for bending section-sheet having corrugations of longitudinal and parallel ridges and valleys by introducing impressions transversely across the corrugated ridges. The method and device are distinguishable for treating only corrugated metal.

U.S. Pat. No. 1,197,271 issued on Sep. 5, 1916, to Ferdinand Dieckmann describes a method of producing sheet metal elbows from cylindrical, rectangular and corrugated metal pipes. Initially, a cylindrical metal pipe has hemispherical crimps made to form the elbow which is then processed by dies to form rectangular corrugated pipes. The method is distinguishable for preforming crimps in cylindrical pipes to form the elbow prior to subsequent forming of rectangular corrugated pipes.

U.S. Pat. No. 4,748,838 issued on Jun. 7, 1988, to Richard C. Cornelison describes a process for making obliquely corrugated thin metal strips by passing a thin metal strip through corrugating helical rolls for impressing a series of single apex, V-shaped chevron corrugations by which the strip can be split into two strips along the apices of the chevrons. The process is distinguishable for forming a chevron design for splitting a strip lengthwise.

None of the above inventions and patents, taken either singly or in combination, is seen to describe the instant invention as claimed.

SUMMARY OF THE INVENTION

The present invention is a method of curling a first metal portion of a planar workpiece over a second cooperating curled workpiece to produce a device such as a door hinge, a lid and the like. The present method includes forming indentations on the inside surface of the first metal portion.

Accordingly, it is a principal object of the invention to provide an innovative method of effectively curling metal portions of a planar workpiece.

It is another object of the invention to provide a method of curling metal portions of a planar workpiece by either a curling tool or roll forming.

It is a further object of the invention to provide a method of curling metal portions of a planar workpiece by forming indentations, wherein several indentations can be combined and the depth of the indentations can be varied.

Still another object of the invention is to provide a method of curling metal portions of small parts and of various thicknesses.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
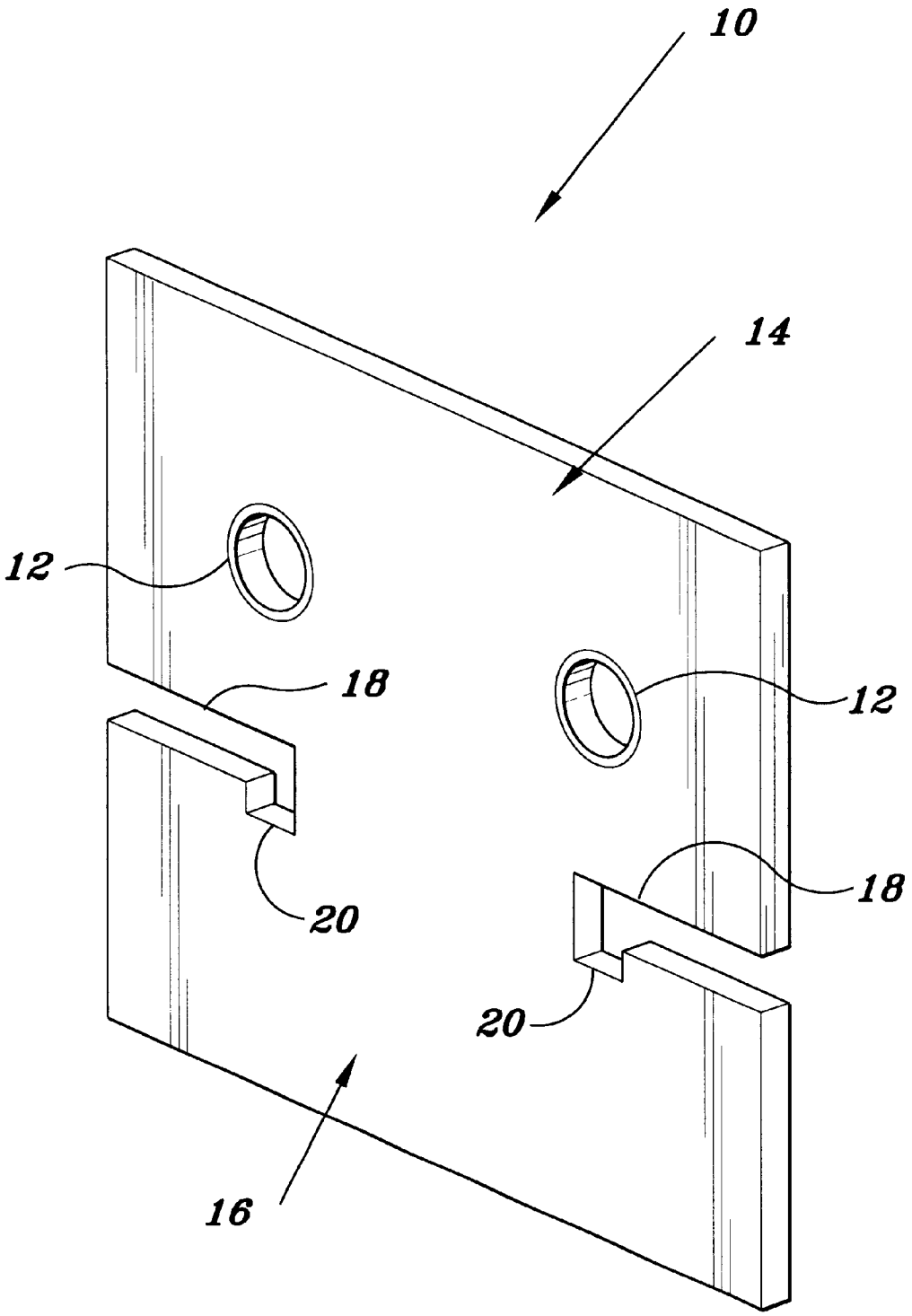
FIG. 1 is a perspective view of a planar metal cutout blank piece for forming the axis portion of a hinge.

The present invention is directed to a curling process for forming a circular configuration of a planar metal blank workpiece. The formation of an exemplary fabricated metal device is a hinge for a door, a lid and the like. In FIG. 1, an H-shaped axis piece blank 10 is illustrated having a pair of precut holes 12 in a rectangular upper portion 14. A lower portion 16 has two horizontally aligned grooves 18 with vertical notches 20 at the ends of the grooves.

Figure 2:
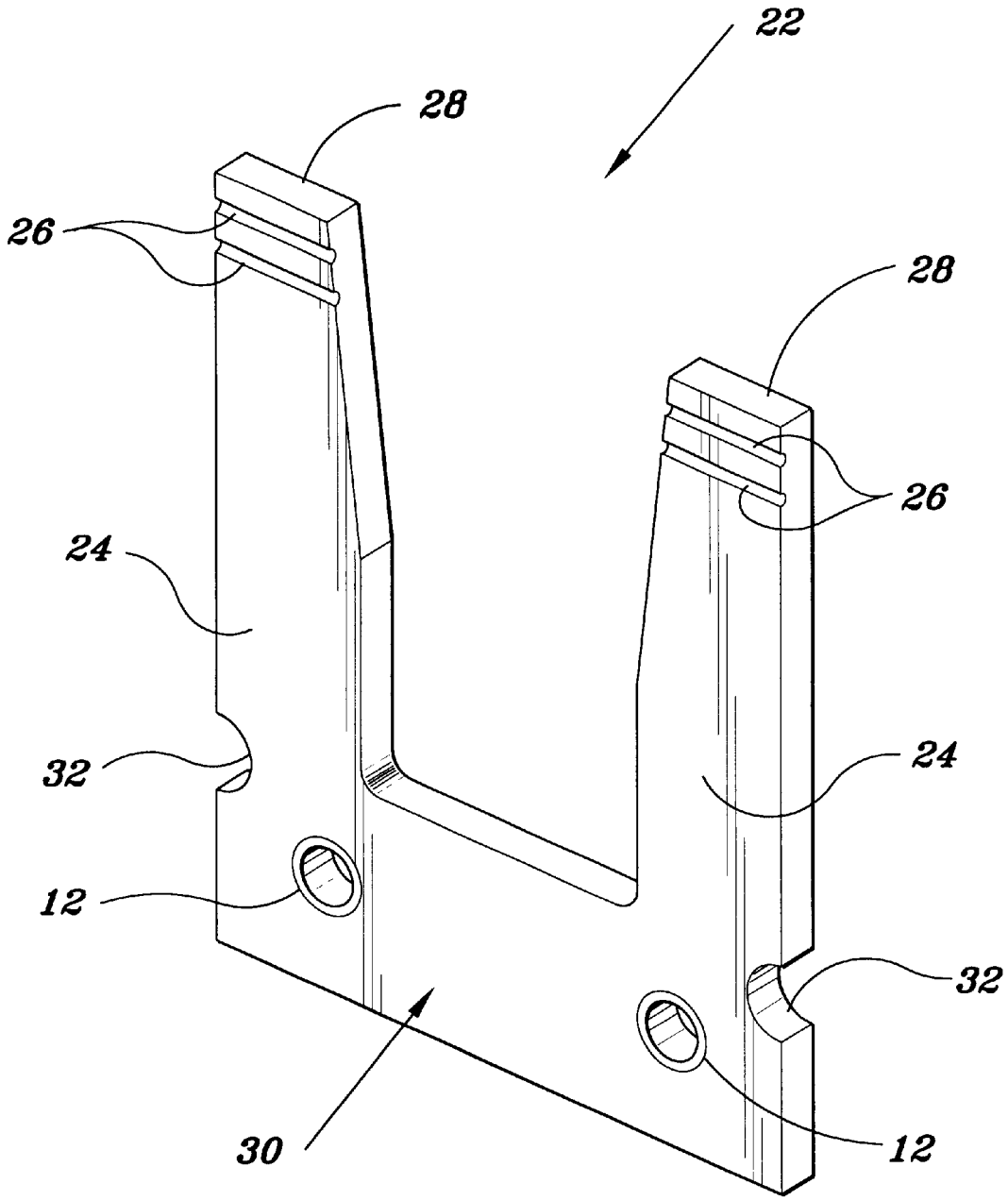
FIG. 2 is a perspective view of a planar metal cutout blank piece for forming the receiver blank cutout of a hinge with indentations to control metal curling according to the present invention.

In FIG. 2, the cooperating receiver workpiece blank 22 is U-shaped with the pair of tabs 24 having a pair of indentations 26 made by cutting or grinding proximate to the top edge 28.

The indentations 26 are critical to the invention in forming a smooth and accurate curl or a roll. The indentations 26 can be combined. A tool such as a machine punch (not shown) can be used in making the indentations 28, which can be of a different size and shape. The configuration of the punch can be modified to accommodate larger and thicker metal tabs. Another advantage of the indentations 28 is that small parts can readily be handled.

In the base region 30, a pair of precut holes 12 are positioned horizontally. Semicircular notches 32 are made along the sides of the base region 30.

Figure 3:
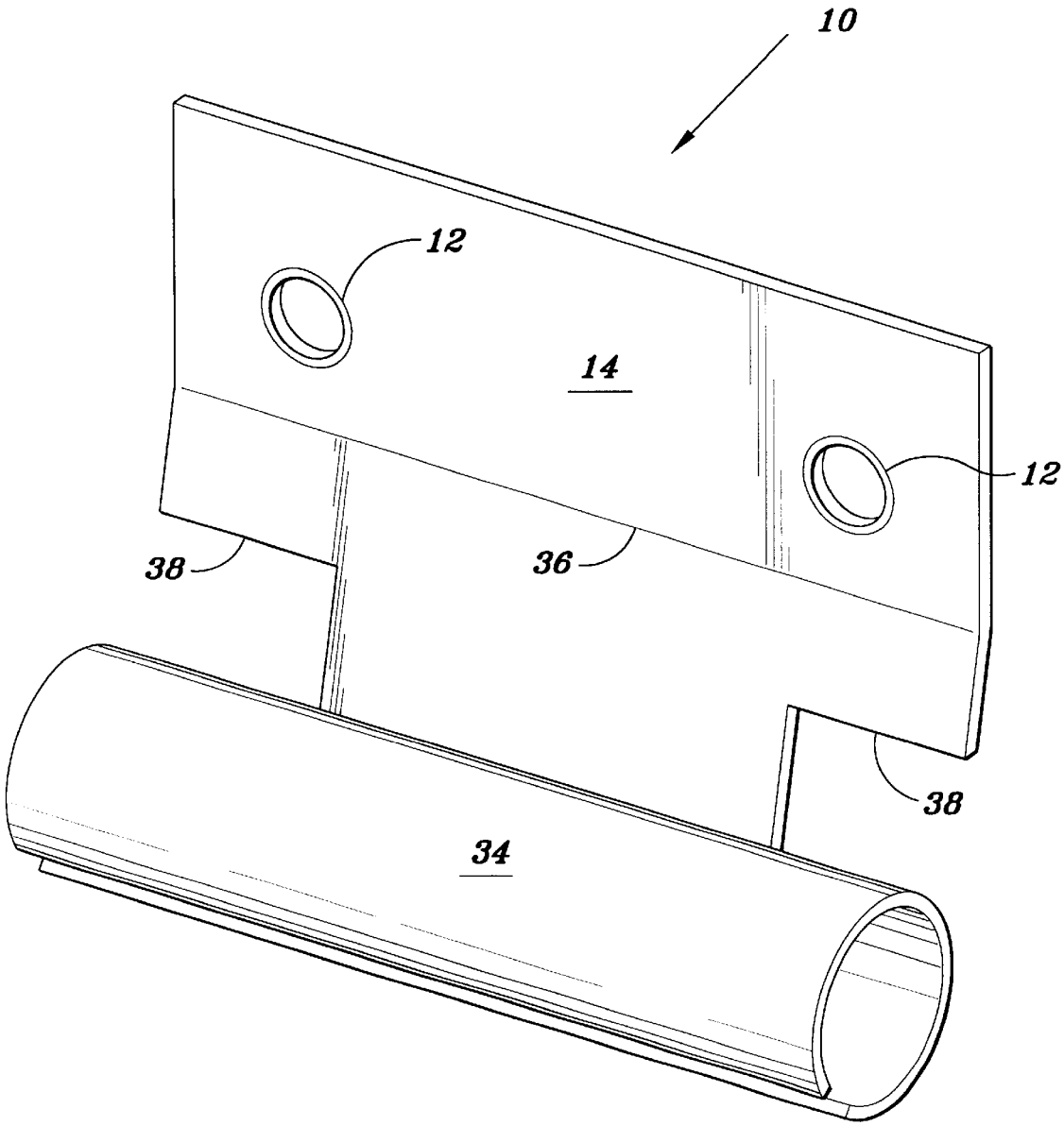
FIG. 3 is a front perspective view of a rolled axis blank.

In FIG. 3, H-shaped axis piece blank 10 has been further shaped by rolling to make a curled inside pin holder portion 34 and a horizontal bend 36 proximate the holes 12 to slightly elevate the curled pin holder 34.

Figure 4:
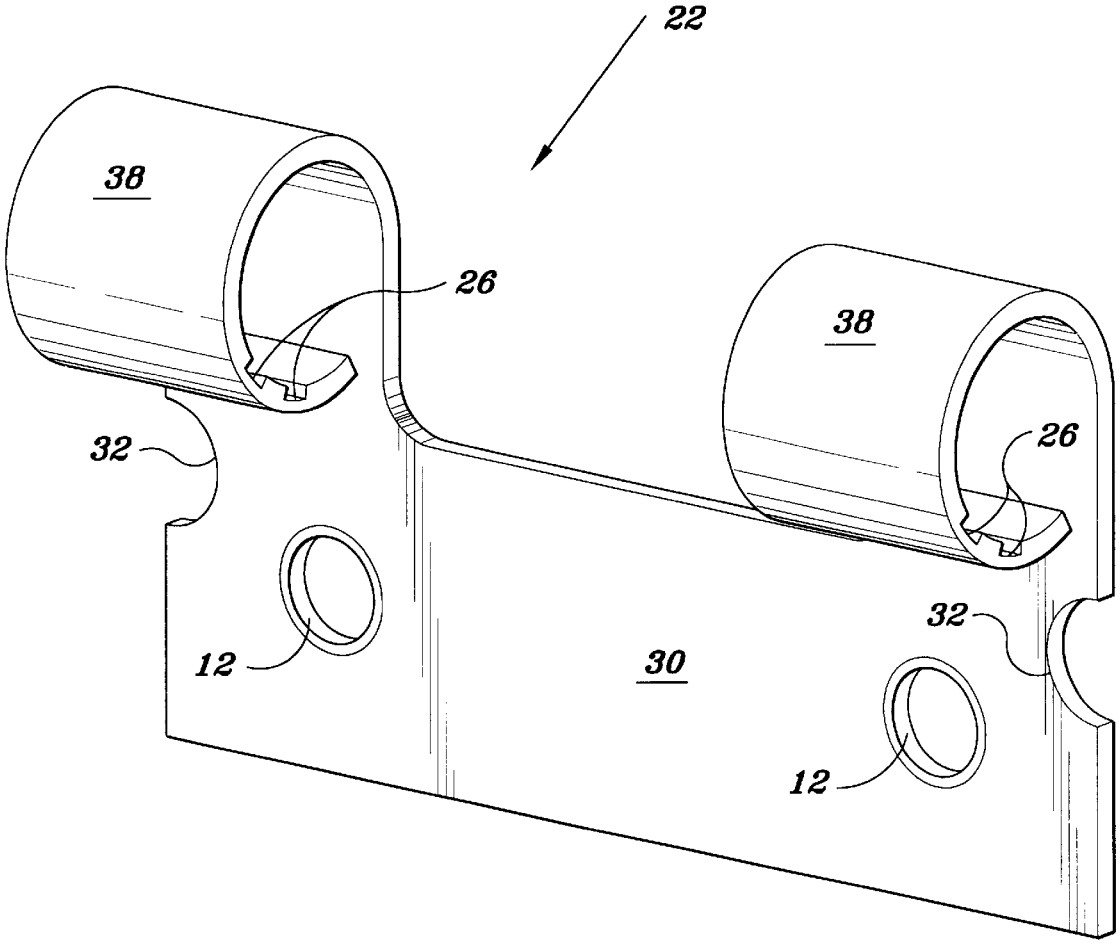
FIG. 4 is a front perspective view of a rolled receiver blank.
Figure 5:
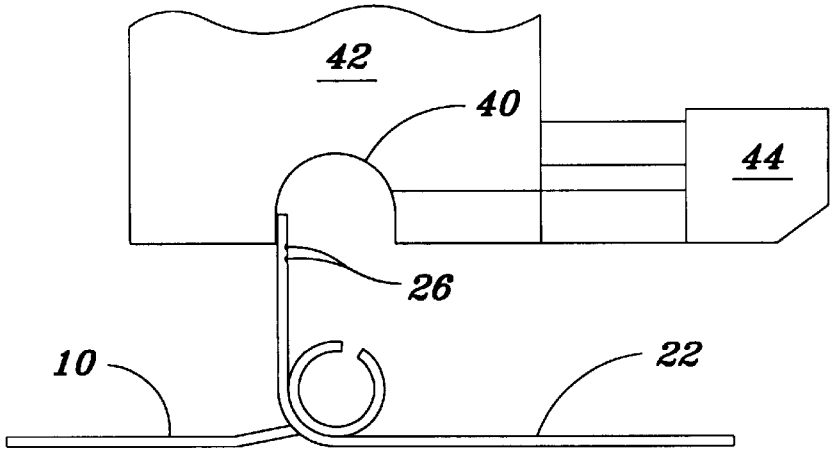
FIG. 5 is the first curling step being performed on an indented receiver blank according to the present invention.
Figure 6:
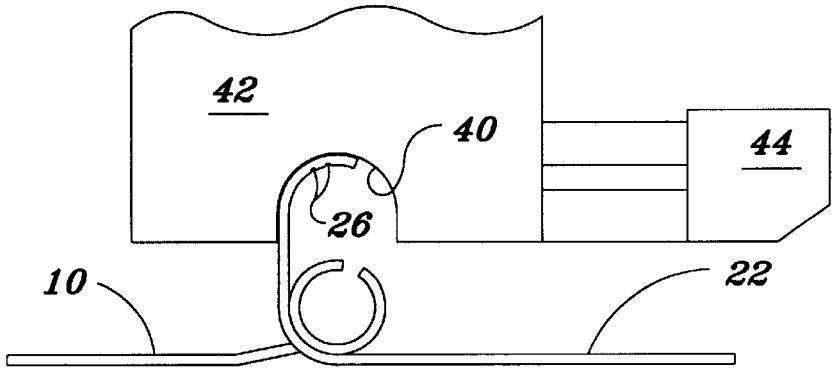
FIG. 6 is the second curling step being performed on the indented receiver blank according to the present invention.
Figure 7:
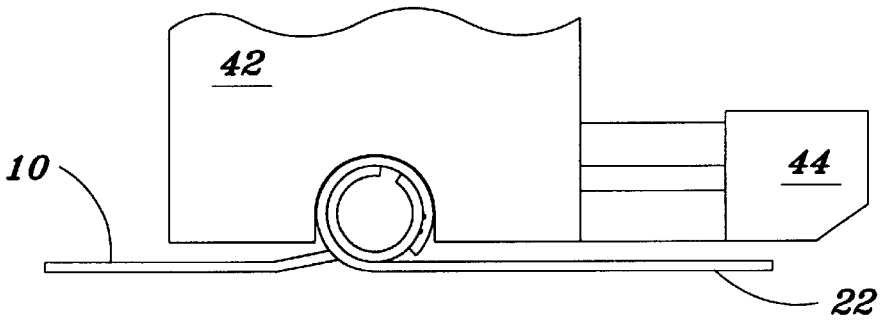
FIG. 7 is the third and final curling step being performed on the indented receiver blank to form an uniform curl according to the present invention.

Turning to FIG. 4, the receiver piece 22 with the indentations 26 is depicted separately after being rolled to form the outside pin holder portion 38 which has a larger inner diameter than the outside diameter of rolled portion of the inside pin holder portion 34. The sequence of rolling the outside pin holder portion 38 over the inside curled pin holder portion 34 is illustrated in FIGS. 5, 6 and 7. In FIG. 5, the receiver piece 22 has the tabs 24 bent upwards initially at a 90°. Then, the receiver piece 22 is placed under the inside curled pin holder portion 34 of the axis piece 10. The semicircular cavity 40 of the curling punch apparatus 42 driven by a cam 44, engages the upright tabs 24 to curl the tabs 24 with the indentations 26 in FIG. 6 as the curling punch 42 is lowered. The curling punch 42 is lowered completely in FIG. 7 to complete the curling operation with a smooth curling of the tabs 24 of the receiver piece 22 over the inside curled pin holder portion 34 of the axis piece 10.

Thus, the present invention of forming indentations in metal portions which must be curled smoothly and accurately has been shown with an exemplary example of forming a hinge.

It is to be understood that the present invention is not limited to the sole embodiment described above, but encompasses any and all embodiments within the scope of the following claims.

I claim:

1. A method of controlling the curling operation of two metal blank workpieces to form a hinge comprising:

providing a first metal blank workpiece cut to a predetermined shape of a hinge receiver blank and having a portion with an inside surface adapted to be curled;

indenting the inside surface of the first blank portion for curling with parallel grooves by a predetermined indenting procedure selected from the group consisting of punching, cutting and filing;

providing a second metal blank workpiece having an axis portion;

curling the axis portion; and curling the indented blank portion of the first metal blank workpiece by one of a curling device or a roll forming device substantially 360° over the curled axis portion of said axis portion containing blank workpiece;

whereby the curled portion of the first metal blank workpiece is smoothly formed without cracks or irregular deformation to form said hinge.

2. The method according to claim 1, wherein the predetermined indenting procedure comprises indenting the inside surface of the blank portion by punching.

3. The method according to claim 1, wherein the indented blank portion is curled by a curling device.

4. The method according to claim 1, wherein the indented blank portion is curled by a roll forming device.

5. The method according to claim 1, wherein the inside surface of the blank portion is indented by cutting.

6. The method according to claim 1, wherein the inside surface of the blank portion is indented by filing.

* * * * *